United States Patent [19]

Asai

[11] 4,244,337

[45] Jan. 13, 1981

[54] IGNITION SYSTEM FOR INTERNAL COMBUSTION ENGINES

[75] Inventor: Masahiro Asai, Hekinan, Japan

[73] Assignee: Nippondenso Co., Ltd., Kariya, Japan

[21] Appl. No.: 42,223

[22] Filed: May 24, 1979

[30] Foreign Application Priority Data

May 30, 1978 [JP] Japan ..... 53-64703

[51] Int. Cl.[3] ..... F02P 3/08; F02P 11/00

[52] U.S. Cl. ..... 123/603; 123/605; 315/209 CD; 315/209 SC; 315/218

[58] Field of Search ..... 123/148 CC, 148 S, 148 E, 123/149 C; 315/209 CD, 209 SC, 218

[56] References Cited

U.S. PATENT DOCUMENTS

| | | | |
|---|---|---|---|
| 3,791,363 | 2/1974 | Schmaldienst et al. | 123/148 CC |
| 3,903,862 | 9/1975 | Nagasawa | 123/148 CC |
| 3,911,889 | 10/1975 | Nagasawa | 123/148 CC |
| 3,961,618 | 6/1976 | Swift | 123/148 CC |
| 4,014,309 | 3/1977 | Nagasawa | 123/148 S |

*Primary Examiner*—Charles J. Myhre
*Assistant Examiner*—Andrew M. Dolinar
*Attorney, Agent, or Firm*—Cushman, Darby & Cushman

[57] ABSTRACT

In an ignition system for internal combustion engines having a magneto generator for charging a capacitor and a thyristor for discharging the capacitor through an ignition coil upon receiving an ignition signal, an auxiliary capacitor and an associated transformer are provided as a source of the ignition signal. The auxiliary capacitor is charged through the transformer by each half-cycle of the magneto generator output of the opposite polarity with respect to the charging half-cycle of the capacitor. The auxiliary capacitor is discharged through the gate-cathode path of the thyristor under control of an auxiliary switching element to which a timing signal generator provides a timing signal at a proper ignition time. Since a short circuiting switching element connected across the auxiliary capacitor has the control electrode connected to receive through a resistor each half-cycle of the magneto generator output following the half-cycle of the magneto generator output during which the auxiliary capacitor is charged, if no timing signal has been applied to the auxiliary switching element the auxiliary capacitor will necessarily be short circuited. When the engine is rotating in the normal direction, the timing signal is only required to be generated during a time period from the completion of charging of the auxiliary capacitor until the short-circuiting switching element is turned on and this allows a sufficient range of advance angle. In the reverse rotation of the engine, the auxiliary capacitor is short circuited before the timing generator generates the timing signal resulting in the termination of the reverse rotation.

3 Claims, 5 Drawing Figures

IGNITION SYSTEM FOR INTERNAL COMBUSTION ENGINES

The present invention relates to improvements in the construction of ignition systems for internal combustions of the type employing a magneto generator as a power source.

In a known ignition system of this type, a capacitor is charged through a diode by the output of the capacitor charging coils of a magneto generator and a thyristor is turned on by the generated output of a timing generator at the time of ignition, whereby in response to the conduction of the thyristor the charge stored in the capacitor is discharged through the primary winding of an ignition coil and an ignition spark is produced at the proper spark plug. When the engine is rotated in the reverse for some reason or other, the output of the timing generator or the output of the capacitor charging coils is short-circuited so as to prevent the engine from rotating continuously in the reverse direction, the ignition is effected at such position that the engine is prevented from rotating continuously in the reverse direction, for example, as disclosed in U.S. Pat. No. 3,903,862, or the capacitor noncharging polarity or the capacitor charging polarity of the capacitor charging coils is detected to prevent the application of a gate signal to the thyristor as disclosed in U.S. Pat. No. 3,791,363.

The ignition system of the type in which the output of the timing generator or the output of the capacitor charging coils is short-circuited to prevent any continued reverse rotation, is disadvantageous in that a specially designed timing generator for short-circuiting such output must be provided in addition to the ordinary ignition timing generator and moreover the generated output of the timing generator must be substantially synchronized in phase with an ignition signal to positively prevent any continued reverse rotation, thus making it almost impossible to effect the spark advance control of ignition signals.

On the other hand, the ignition system of the type in which the output polarity of the capacitor charging coils is detected to prevent the application of a gate signal to the thyristor and thereby to prevent any continued reverse rotation, is disadavantageous in that due to the fact that the generated output of the capacitor charging coils varies according to the engine speed, if the capacitor noncharging polarity of the capacitor charging coils is utilized, during the periods of high speed operation the gate voltage for the thyristor will become excessively high with the possibility of damaging the thyristor, and moreover in order to overcome this deficiency, if the capacitor noncharging polarity output of the capacitor charging coils is detected by means of a transformer, the detection output range will be reduced thus making it impossible to ensure a sufficient advance angle range for ignition signals, whereas if the capacitor charging polarity output of the capacitor charging coils is utilized, although the gate voltage for the thyristor will be kept within the limits by means of the capacitor charging during high speed operations, at low speed operations the capacitor charging will limit the range in which the capacitor charging polarity output can be detected thus making it impossible to ensure a sufficient advance angle range for ignition signals.

With a view to overcoming these deficiencies, it is the object of the invention to provide an ignition system for internal combustion engines in which there is no need to provide any reverse rotation preventive timing generator in addition to the ordinary timing generator for ignition purposes, and moreover there is no danger of the thyristor gate voltage becoming excessively high thus ensuring a sufficient advance angle range for ignition signals.

Thus in accordance with the present invention, an auxiliarity capacitor is charged through a transformer by a capacitor noncharging polarity half-wave output of capacitor charging coils and the auxiliary capacitor is adapted so that it is short-circuited through a short-circuiting semiconductor switching device adapted to be turned on by a capacitor charging polarity half-wave output of the capacitor charging coils and the charge stored in the auxiliary capacitor is supplied to the gate of an ignition thyristor through an auxiliary semiconductor switching device adapted to be turned on by a timing generator which generates an ignition signal when the capacitor noncharging polarity half-wave output is being generated from the capacitor charging coils during the normal rotation of the engine.

Thus the ignition system of the invention has among its great advantages the fact that it is only necessary to ensure that during the normal engine operation (rotating in the normal direction) the timing generator generates an ignition signal during the time interval between the time that the auxiliary capacitor is charged through the transformer by a capacitor noncharging polarity half-wave output of the capacitor charging coils and the time that the short-circuiting switching device is short-circuited by a capacitor charging polarity half-wave output of the capacitor charging coils, with the result that it is possible to ensure a sufficient advance angle range for ignition signals and moreover during the reverse rotation of the engine the charge stored in the auxiliary capacitor will be discharged prior to the generation of an ignition signal from the timing generator thus positively preventing any continued reverse rotation of the engine.

Another great advantage of the system is that since the engine is prevented from rotating in the reverse direction by means of the generated output of the capacitor charging coils there is no need to provide any reverse rotation preventive timing generator in addition to the ignition timing generator, and moreover since the auxiliary capacitor is charged by the capacitor noncharging polarity half-wave output of the capacitor charging coils through the transformer there is no danger of the thyristor gate voltage becoming excessively high.

For a better understanding of the invention together with additional objects, advantages and features thereof, reference is made to the accompanying drawings, in which.

The present invention will now be described in greater detail with reference to the illustrated embodiment.

Figure 1:
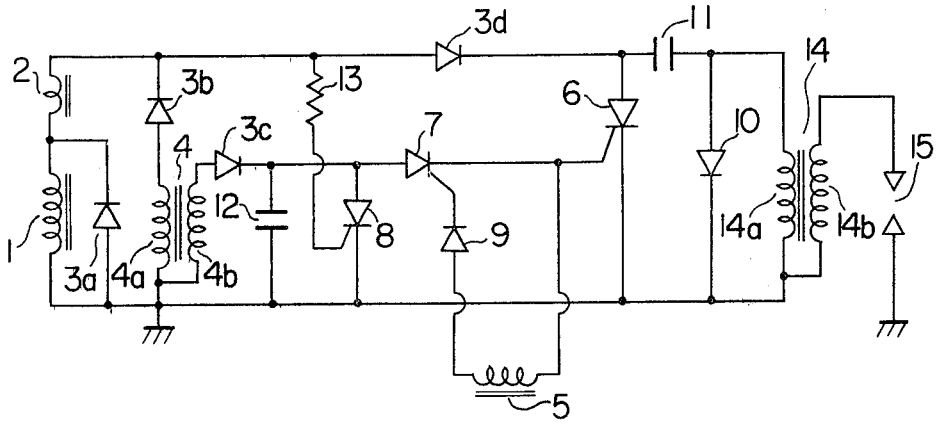
FIG. 1 is a circuit diagram showing an embodiment of an ignition system according to the invention.

Referring to FIG. 1, numerals 1 and 2 designate low-speed and high-speed capacitor charging coils of a magneto generator which are connected in series with each other and grounded at one ends thereof, 3*a* a diode connected in inverse parallel with the low-speed capacitor charging coil 1, and 3*b* to 3*d* diodes. Numeral 4 designates a transformer having a primary winding 4*a* and a secondary winding 4*b* and connected between the terminals of the capacitor charging coils 1 and 2 through the reverse-polarity diode 3*b*, 5 the signal coil of a timing generator, and 6 a thyristor having its anode connected to the high-speed capacitor charging coil 2 through the diode 3*d* and its cathode connected to the ground. Numeral 7 designates an auxiliary thyristor having its anode connected to the secondary winding 4*b* of the transformer 4 through the diode 3*c* and its cathode connected to the gate of the thyristor 6, and 8 a short-circuiting thyristor having its anode connected to the cathode of the diode 3*c* and its cathode connected to the ground. Numeral 9 designates a diode connected between the gate and cathode of the auxiliary thyristor 7 through the timing generator signal coil 5, 10 a diode having its cathode connected to the ground, and 11 a capacitor having its one end connected to the anode of the thyristor 6 and the other end connected to the anode of the diode 10. Numeral 12 designates an auxiliary capacitor connected in parallel between the anode and cathode of the short-circuiting thyristor 8, and 13 a resistor having its one end connected to the anode of the diode 3*d* and the other end connected to the gate of the short-circuiting thyristor 8. Numeral 14 designates an ignition coil having a primary winding 14*a* and a secondary winding 14*b* and connected in parallel between the terminals of the diode 10, and 15 a spark plug connected to the secondary winding 14*b* of the ignition coil 14.

Figure 4:
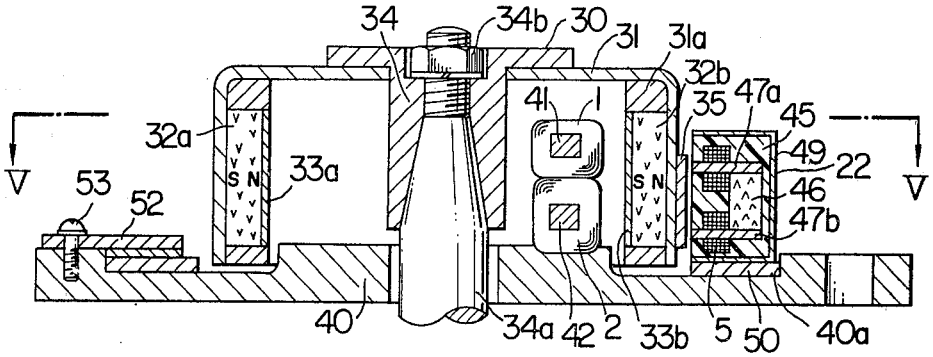
FIGS. 4 and 5 show an exemplary form of a magneto generator adapted for use with the embodiment shown in FIG. 1, with FIG. 4 showing a longitudinal sectional view taken along the line IV—IV of FIG. 5 and FIG. 5 showing a cross-sectional view taken along the line V—V of FIG. 4.
Figure 5:
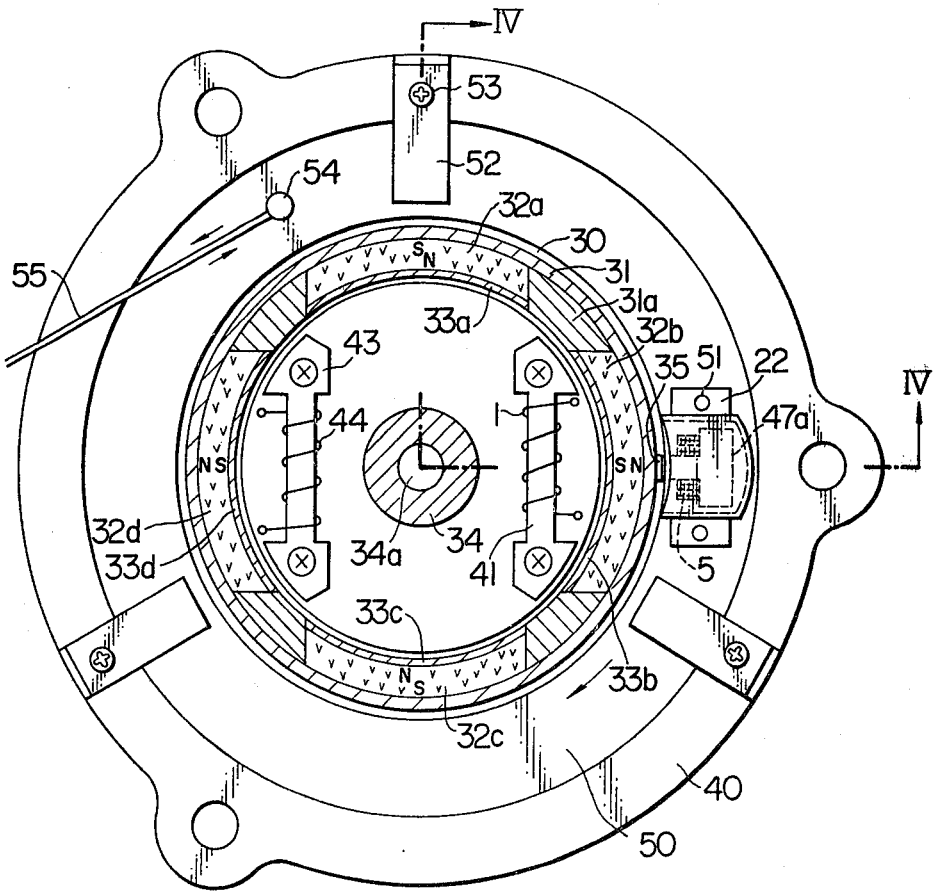

Next, the construction of the preveiously mentioned magneto generator will be described with reference to FIGS. 4 and 5 in which numeral 30 designates a rotor comprising an iron shell 31, permanent magnets 32*a*, 32*b*, 32*c* and 32*d* which are spaced equally on the inner surface of the iron shell 31 and embedded fixedly in place by means of a nonmagnetic material 31*a* such as aluminum or resin material, pole pieces 33*a*, 33*b*, 33*c* and 33*d* which are respectively secured to the inner surface of the permanent magnets 32*a*, 32*b*, 32*c* and 32*d*, a center piece 34 fixedly mounted on an engine crankshaft 34*a* with a nut 34*b* and securely joined with the iron shell 31 with rivets which are not shown and a timing core 35 attached to the outer surface of the iron sheel 31. Numeral 40 designates a stator mounted fixedly to the engine. Numerals 41 and 42 designate capacitor charging cores which are placed one upon another and fixedly mounted in the same position on the stator 40, and the capacitor charging coils 1 and 2 are respectively wound on the cores 41 and 42. Numeral 43 designates a lamp load core which is fixedly mounted in a position opposite to or spaced apart by about 180° from the position of the capacitor charging cores 41 and 42, and wound on the core 43 is a lamp load supply coil 44 constituting a power supply for a load such as a lamp. Numeral 22 desigates the stator of the timing generator comprising a permanent magnet 46, cores 47*a* and 47*b* arranged on both sides of the magnet 46, the generating coil 5 wound on the cores 47*a* and 47*b* respectively and connected in series with each other, a case 49 for housing these elements and a sealing resin 45 placed in the case 49. Numeral 50 designates a movable member in the form of a ring plate which is rotatably fitted in a ring groove 40*a* formed in the stator 40, and the timing generator stator 22 is fixedly mounted in a predetermined position on the movable member 50 by means of rivets 51. Numeral 52 designates keep plates which are fixed with screws 53 to the outer periphery of the stator 40 at a plurality of locations so as to hold the movable plate 50 in the groove 40*a* and prevent the former from slipping out of the latter. Numeral 54 designates a pin fixedly mounted in the movable member 50, and 55 a wire movable in the directions of arrows in response to the opening and closing of the engine throttle valve and secured at its one end to the pin 54. As a result, the timing generator stator 22 fixed on the movable member 50 is rotatable in response to the opening and closing of the throttle valve. With the magneto generator constructed in this manner, the capacitor charging coils 1 and 2 generate two cycles of a no-load alternating voltage as shown by the solid line in (a) of FIG. 2 for each revolution of the magneto generator or each revolution of the engine crankshaft 34*a*, and the timing generator generates an output voltage such as shown in (b) of FIG. 2 for each revolution of the crankshaft 34*a*.

Figure 2:
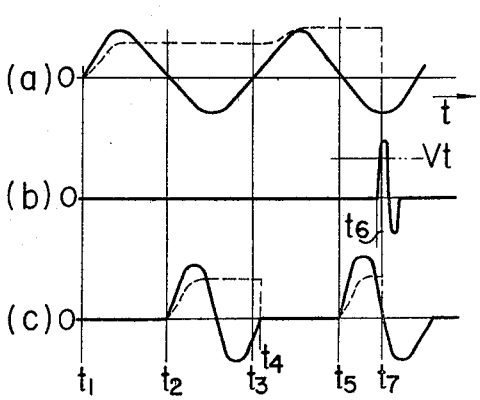
FIGS. 2 and 3 are waveform diagrams which are useful for explaining the operation of the embodiment shown in FIG. 1.

With this construction, the operation of the embodiment during the normal engine operation will be described first with reference to the waveform diagram of FIG. 2. When the generated output of the capacitor charging coils 1 and 2 increases in a capacitor charging direction at a time $t_1$ in FIG. 2, the capacitor 11 is charged as shown by the broken line in (a) of FIG. 2 through a circuit comprising the diode 3*d*, the capacitor 11 and a parallel circuit of the diode 10 and the primary winding 14*a* of the ignition coil 14. Then, when the generated output of the capacitor charging coils 1 and 2 increases in the opposite or capacitor noncharging direction at a time $t_2$ in FIG. 2, a current flows from the high-speed capacitor charging coil 2 to the primary winding 4*a* of the transformer 4 through the diode 3*b* and consequently a voltage is generated in the secondary winding 4*b* as shown by the solid line in (c) of FIG. 2. This voltage charges the auxiliary capacitor 12 through the diode 3*c* as shown by the broken line in (c) of FIG. 2. When the generated voltage of the capacitor charging coils 1 and 2 again increases in the capacitor charging direction at a time $t_3$ in FIG. 2 so that the capacitor 11 is again charged and a gate voltage is applied to the short-circuiting thyristor 8 through the resistor 13, at the instant that the gate voltage reaches the gate trigger level of the short-circuiting thyristor 8 at a time $t_4$ in FIG. 2, the thyristor 8 is turned on and the charge stored in the auxiliary capaciator 12 is discharged. Then, when the generated voltage of the capacitor charging coils 1 and 2 again increases in the capacitor noncharging direction at a time $t_5$ in FIG. 2, the auxiliary capacitor 12 is charged. Thus, the voltage shown in (b) of FIG. 2 is generated in the timing generator signal coil 5 at a time $t_6$ in FIG. 2 at which the auxiliary capacitor 12 has been charged and the noncharging polarity half-wave output is being generated from the capacitor charging coils 1 and 2, so that at the instant that the generated voltage attains the gate trigger level $V_t$ of the auxiliary thyristor 7, at a time $t_7$ of FIG. 2 or the time of ignition the auxiliary thyristor 7 is turned on and the charge stored in the auxiliary capacitor 12 is applied to the gate of the thyristor 6. When this occurs, at the time $t_7$ in FIG. 2 the thyristor 6 is turned on and the charge stored in the capacitor 11 is discharged through the primary winding 14*a* of the ignition coil 14, thus generating a high voltage in the secondary winding 14*b* and thereby producing an ignition spark at the spark plug 15.

The above-mentioned process is repeatedly performed to produce ignition sparks, one for each revolution of the engine.

Figure 3:
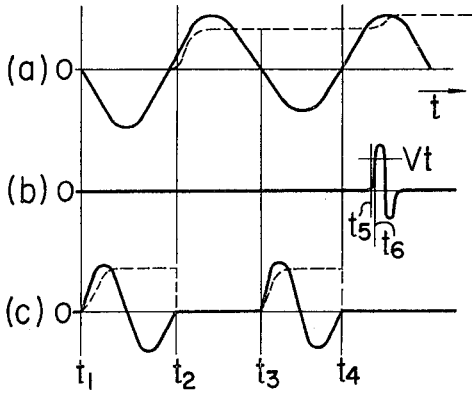

Next, the operation of the embodiment at the reverse rotation of the engine will be described with reference to the waveform diagram of FIG. 3. As shown by the solid line in (a) of FIG. 3, the generated voltage of the capacitor charging coils 1 and 2 becomes opposite in polarity to that generated during the normal rotation of the engine as shown by the solid line in (a) of FIG. 2. Thus, when the generated output of the capacitor charging coils 1 and 2 increases in the capacitor non-charging direction at a time $t_1$ in FIG. 3, an output is generated from the secondary of the transformer 4 as shown by the solid line in (c) of FIG. 3 and the auxiliary capacitor 12 is charged as shown by the broken line in (c) of FIG. 3. Thereafter, when the generated output of the capacitor charging coils 1 and 2 increases in the capacitor charging direction so that the capacitor 11 is charged as shown by the broken line in (a) of FIG. 3 and a gate voltage is applied to the short-circuiting thyristor 8, at the instant that the gate voltage attains the gate trigger level of the short-circuiting thyristor 8 at a time $t_2$ in FIG. 3 the thyristor 8 is turned on and the charge stored in the auxiliary capacitor 12 is discharged. Then, when the generated output of the capacitor charging coils 1 and 2 again increases in the capacitor noncharging direction at a time $t_3$ in FIG. 3, an output is generated from the secondary of the transformer 4 and the auxiliary capacitor 12 is again charged. Thereafter, when the generated output of the capacitor charging coils 1 and 2 increases in the capacitor charging direction so that the capacitor 11 is again charged and a gate voltage is applied to the short-circuiting thyristor 8, at the instant that the gate voltage attains the gate trigger level of the short-circuiting thyristor 8 at a $t_4$ in FIG. 3 the charge stored in the auxiliary capacitor 12 is discharged. Thus, the voltage shown in (b) of FIG. 3 is generated in the timing generator signal coil 5 at a time $t_5$ in FIG. 3 at which the charge stored in the auxiliary capacitor 12 has been discharged and the capacitor charging polarity half-wave output is being generated from the capacitor charging coils 1 and 2, and consequently even if the voltage attains the gate trigger level $V_t$ of the auxiliary thyristor 7 at a time $t_6$ in FIG. 3 which is near the time of ignition, since the charge stored in the auxiliary capacitor 12 has already been discharged, no gate singal is applied to the thyristor 6 and no ignition spark is produced at the spark plug 15, thus preventing any continued reverse rotation of the engine.

On the other hand, due to the fact that the timing generator stator 22 fixedly mounted on the movable member 50 is rotated through the wire 55 in response to the opening and closing of the engine throttle valve, the relative positional relation between the stator 22 and the timing core 35 is varied and thus the spark timing is advanced (or retarded).

While, in the embodiment described above, the thyristors 8 and 7 are used respectively for the short-circuiting switching device and the auxiliary switching device, any other semiconductor switching devices, such as transistors may be used.

Further, while in the above-described embodiment, the invention is applied to an ignition system designed to control the spark advance angle in accordance with the position of the throttle valve, the invention may be applied to an ignition system designed to control the spark advance angle in accordance with the engine speed, intake vacuum or the like.

We claim:

1. An ignition system for internal combustion engines comprising:

a magneto generator coupled with a crankshaft of an internal combusion engine to generate an AC output, a capacitor connected to said magneto generator and being charged through a diode by each half-cycle of one polarity of the AC output of said magneto generator, an ignition coil having a primary coil connected to said capacitor and having a secondary coil connected to an ignition plug, a thyristor connected in series with said capacitor and said primary coil of said ignition coil to form a discharging path of said capacitor, an auxiliary capacitor, a transformer for charging said auxiliary capacitor by each half-cycle of the other polarity of the AC output of said magneto generator, a first semiconductor switching element connected across said auxiliary capacitor for short circuiting said auxiliary capacitor, a first switching element control circuit for turning on said first semiconductor switching element by each half-cycle of said one polarity of the AC output of said magneto generator, a second semiconductor switching element connected between said auxiliary capacitor and a gate of said thyristor and upon being turned on for discharging the electric charge of said auxiliary capacitor through a gate-cathode path of said thyristor, and a timing generator connnected to apply an output to a gate of said second semiconductor switching element to turn on the same and to render said thyristor conductive, said timing generator generating the output at a predetermined ignition time and within a half-cycle of said other polarity of the AC output of said magneto generator when said internal combustion engine is rotating in a normal direction.

2. An ignition system accoring to claim 1, wherein said first switching element control circuit comprises a resistor having one end connected to receive each half-cycle of said one polarity of the AC output of said magneto generator and having the other end connected to a control electrode of said first semiconductor switching element.

3. An ignition system according to claim 1, wherein said timing generator generates the output, when said internal combustion engine is rotating in a reverse direction, within a half-cycle period of said one polarity of the AC output of said magneto generator and after said auxiliary capacitor has been short circuited by said first semiconductor switching element thereby to prevent ignition of said ignition plug.

* * * * *